US006640934B1

(12) United States Patent
Edwards

(10) Patent No.: US 6,640,934 B1
(45) Date of Patent: Nov. 4, 2003

(54) RESIDENTIAL CARGO LIFT

(76) Inventor: Ricky L. Edwards, 108 Driftwood Dr., Shiloh, NC (US) 27995

( * ) Notice: Subject to any disclaimer, the term of this patent is extended or adjusted under 35 U.S.C. 154(b) by 71 days.

(21) Appl. No.: 09/846,569

(22) Filed: May 1, 2001

Related U.S. Application Data

(60) Provisional application No. 60/200,899, filed on May 1, 2000.

(51) Int. Cl.[7] ..... G66B 9/00; E04G 3/04

(52) U.S. Cl. ..... 187/239; 187/254; 187/262; 187/900; 182/141

(58) Field of Search ..... 187/239, 240, 187/241, 242, 243, 254, 261, 262, 900; 182/148, 141

(56) References Cited

U.S. PATENT DOCUMENTS

| | | | | | |
|---|---|---|---|---|---|
| 687,126 | A | * | 11/1901 | Cease | 182/141 |
| 710,686 | A | * | 10/1902 | Harris | 182/141 |
| 780,711 | A | * | 1/1905 | Donnell | 182/141 |
| 936,911 | A | * | 10/1909 | Klaus et al. | 187/241 |
| 1,115,093 | A | * | 10/1914 | Nemeth | 187/239 |
| 1,634,585 | A | * | 7/1927 | Kreider | 16/194 |
| 1,834,652 | A | * | 12/1931 | Schmid | 187/900 |
| 2,531,346 | A | * | 11/1950 | Chuchert | 187/239 |
| 2,621,820 | A | * | 12/1952 | O'Sullivan | 187/900 |
| 3,053,344 | A | * | 9/1962 | Buck | 187/261 |
| 3,088,545 | A | * | 5/1963 | Meyer | 182/142 |
| 3,508,632 | A | * | 4/1970 | Elmore | 187/262 |
| 3,517,774 | A | * | 6/1970 | Meyer | 187/239 |
| 3,752,263 | A | * | 8/1973 | Thevenot | 182/148 |
| 3,951,236 | A | * | 4/1976 | Schreiber et al. | 187/241 |
| 4,015,685 | A | * | 4/1977 | Lenz | 187/244 |
| 4,262,773 | A | * | 4/1981 | Basham | 187/241 |
| 4,262,777 | A | * | 4/1981 | Christopher | 182/141 |
| 4,350,224 | A | * | 9/1982 | Jochum et al. | 187/239 |
| 4,469,198 | A | * | 9/1984 | Crump | 182/141 |
| 4,557,353 | A | * | 12/1985 | Pichon | 187/242 |
| 4,706,779 | A | * | 11/1987 | Bono | 182/145 |
| 5,575,356 | A | * | 11/1996 | Chen et al. | 187/239 |
| 5,595,265 | A | * | 1/1997 | Lebrocquy | 187/261 |
| 5,927,432 | A | * | 7/1999 | Hershtik | 187/239 |

FOREIGN PATENT DOCUMENTS

| | | | | |
|---|---|---|---|---|
| CA | 950840 | * | 7/1974 | 187/239 |
| DE | 3335223 | * | 2/1985 | 187/239 |
| DE | 250108 | * | 9/1987 | 187/241 |
| FR | 1170650 | * | 1/1959 | 187/262 |
| SU | 629153 | * | 10/1978 | 187/239 |
| SU | 740677 | * | 6/1980 | 187/239 |

* cited by examiner

*Primary Examiner*—Eileen D. Lillis
*Assistant Examiner*—Paul T. Chin
(74) *Attorney, Agent, or Firm*—Mills Law Firm PLLC

(57) ABSTRACT

A cargo lift for transporting goods between ground level and a raised handling position at the side of a building includes a vertical mast extending between ground level and the handling position alongside the building. A cargo container for carrying the goods is attached to a rolling sleeve carried on the mast. An electric winch raises the cargo container along the mast between ground level and raised handling position.

9 Claims, 10 Drawing Sheets

RESIDENTIAL CARGO LIFT

RELATED APPLICATION

This application claims the benefit under 35 USC 121 of United States Provisional Application No. 60/200,899 filed on May 1, 2000 in the name of Ricky L. Edwards and entitled "Residential Cargo Lift".

FIELD OF THE INVENTION

The present invention relates to lifting devices for transporting cargo between ground level and upper stories in residential dwellings.

BACKGROUND OF THE INVENTION

Multiple occupancy, multistory residential units, either owned or leased, oftentimes do not have elevators or interior stairwells for transporting goods and other cargo to above ground units. In such cases, cargo access is provided by exterior stairs, landings and balconies. Many such units may involve carrying large and cumbersome items up a large number of steeply inclined steps. With regard to rental vacation properties, a substantial number of items must be transported daily, up and down, between the unit and the user's vehicle. Typical goods and supplies, while oftentimes bulky and numerous, are generally lightweight.

Various commercial hoist systems have been proposed for raising and lowering construction supplies. Therein capacities are significant, both in terms of weight and size. Accordingly, the lifting systems are massive and complex, placing such devices beyond the range of needs and costs for residential purposes.

By way of example, U.S. Pat. No. 4,557,353 to Pichon discloses a construction service elevator having a free standing tower that raises an enclosed cabin for delivering supplies and materials to elevated floors at a construction project. The mast is formed of multiple metal panels and a complex rail system for elevating the cabin. A similar complex commercial hoist in disclosed in U.S. Pat. No. 1,834,652 to Schmid and U.S. Pat. No. 3,088,545 to Meyer.

Lighter duty lifts have also been proposed for construction materials. Nonetheless the masts, guide structures and support attachment are geared for the commercial environment and excessive in size and cost for the lesser requirements of individual usage. Examples of the foregoing are winch operated hoists as disclosed in U.S. Pat. Nos. 3,276,545 to Slais, 2,531,346 to Schuchert, U.S. Pat. No. 710,686 to Harris, U.S. Pat. No. 3,951,236 to Schribler et al., U.S. Pat. No. 4,262,773 to Basham, and U.S. Pat. No. 5,575,356 to Chen et. al.

Individual personnel lifts, primarily for enabling disabled hunters to raise their wheelchairs into trees, have been proposed as disclosed in U.S. Pat. No. 5,595,265 to Lebrocquy wherein a wheeled and trailerable portable mast may be anchored to a tree and a wheelchair platform elevated by a winch to raised the disabled person into hunting position.

The foregoing hoists, however, do not provide a means for handling in a cost effective manner the various and sundry goods and supplies for personal usage, where living quarters are vertically separated from the vehicle transfer site.

BRIEF SUMMARY OF THE INVENTION

The present invention provides a readily installed cargo lift for multiple user, exterior stairway residential units that facilitates the transfer of cargo to and from the user's vehicle to an accessible exterior landing with guard rails, such as a porch or balcony. The lift includes a rectangular tubular mast that is attached at a lower end to a permanent base adjacent landing at attached at an upper end to the building. A drive unit is compactly carried on the mast at a height of about a conventional automobile trunk or light truck bed. A carrier sleeve is disposed over the mast and includes guide rollers for permitting stable translation along the length of the mast between a lower position at the drive unit an elevated positions corresponding to the guard rails at the exterior landings. A cargo container is cantilevered to the sleeve and has an upwardly and forwardly opening receptacle positioned for loading and unloading at the railing of the landing such that the user may conveniently load and unload the materials and supplies. The sleeve has a lower stop position at the drive unit for convenient location to the trunk or bed of the transport vehicle. The sleeve is selectively moved between the landings and the vehicle by an electric winch on the drive unit. The winch cable is routed interior of the mast over a top pulley and downwardly attached to the sleeve. The winch is operated by a control unit positioned at ground level and lockable to provide controlled access to authorized parties only. The raised loading position may be enclosed or screened to reduce access by children. The resultant cargo lift enables residents ready transfer of goods between elevated living units and ground level without the need to traverse hazardous stairways.

Accordingly, it is an object of the present invention to provide a residential cargo lift permitting the transfer of goods and supplies between ground level and elevated exterior landings adjacent living units.

Another object of the invention is to provide a compact and secure exterior cargo lift system for allowing authorized parties to transfer items between vertical residence locations.

A further object of the invention is to provide a mast supported cargo lift for personal supplies that allows a user to transfer goods from vehicle height to a vertical hoist for delivery to an elevated exterior landing.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
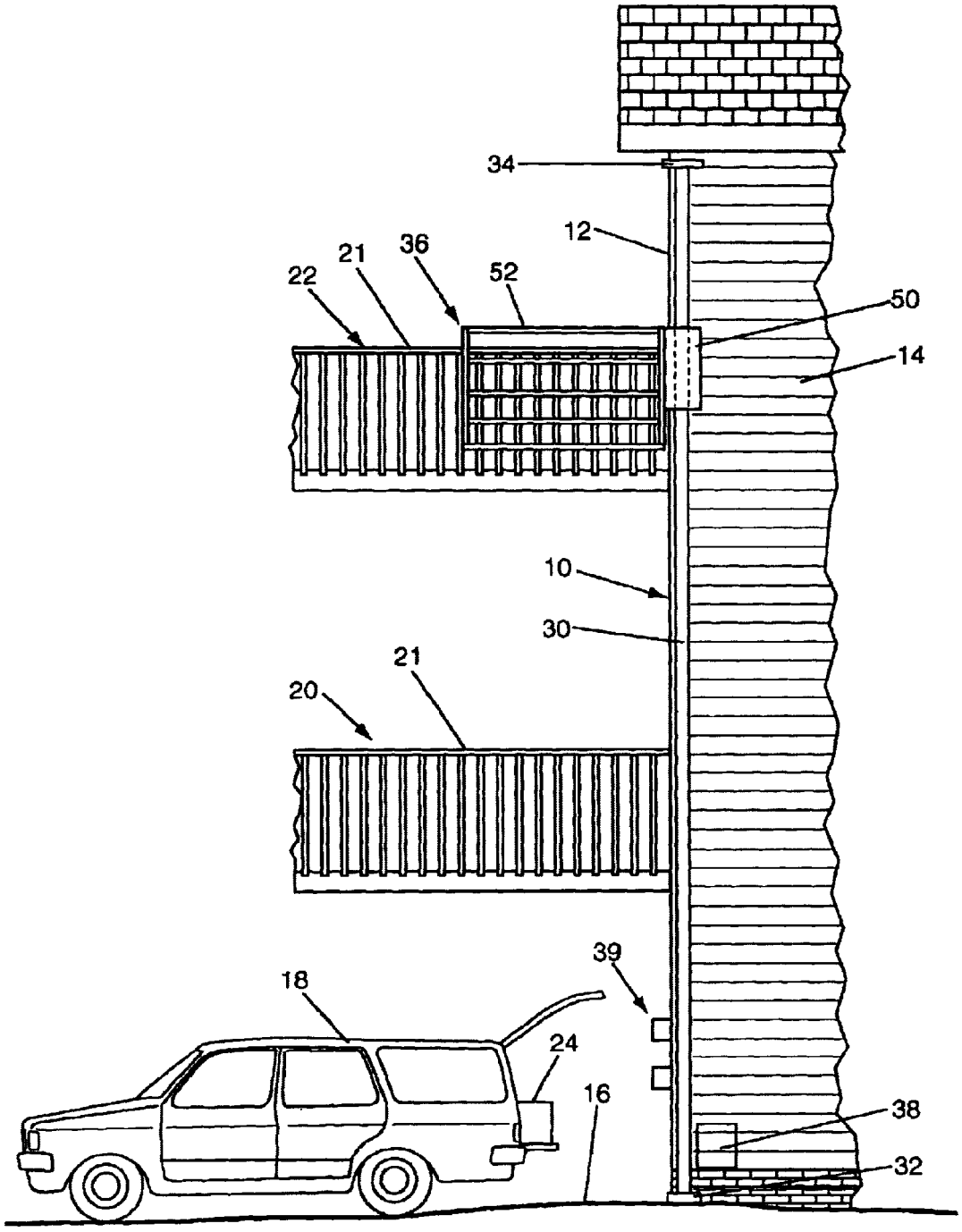
FIG. 1 is a perspective view of a residential cargo lift in accordance with a preferred embodiment mounted at a side of a residential building.
Figure 2:
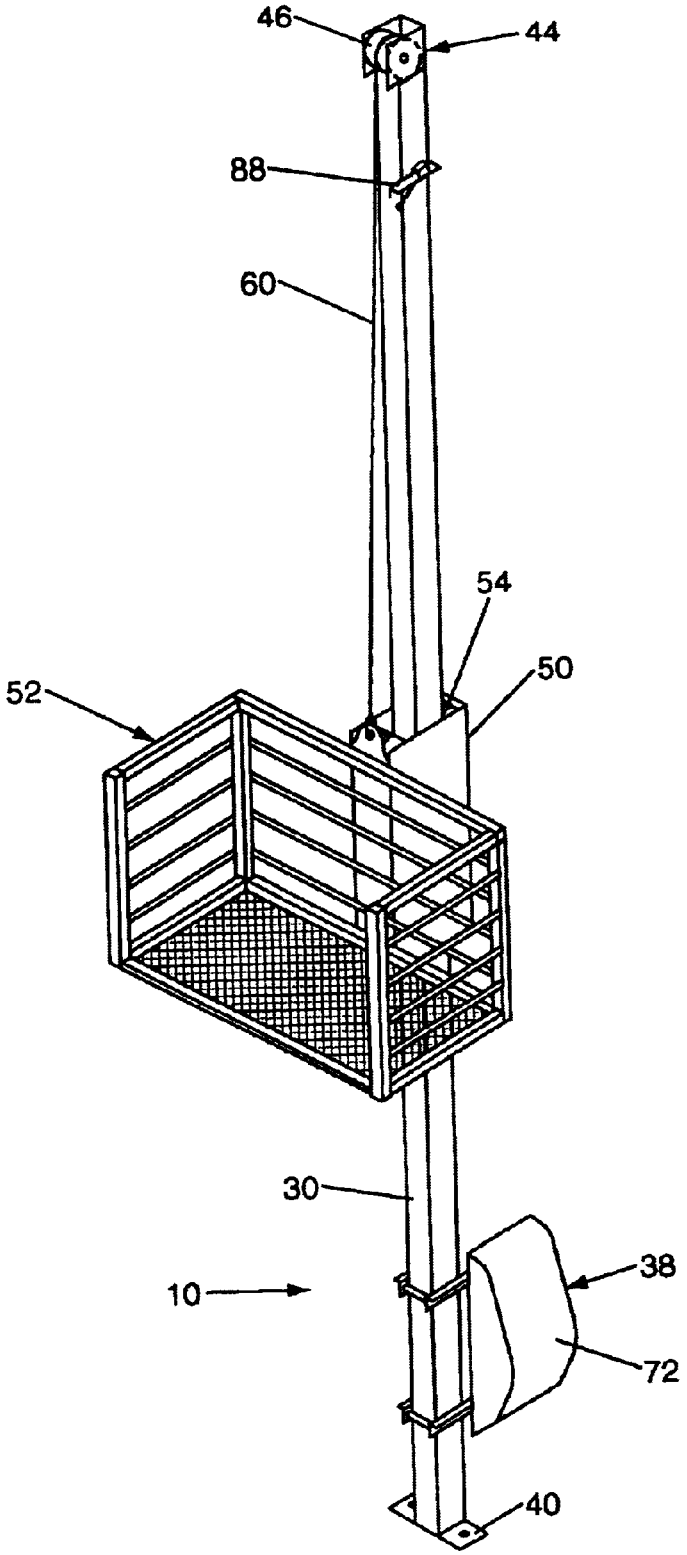
FIG. 2 is a perspective view of the cargo lift illustrated in FIG. 1.

Referring to the drawings for purpose of describing the preferred embodiments, FIG. 1 illustrates a residential cargo lift 10 vertically mounted along an exterior wall 12 of a building 14 for transporting cargo between ground level 16 in the proximity to the trunk bed of a transporting vehicle 18 and one or more elevated unloading areas 20 and 22 exterior of the building and accessible by a suitable stairway. The areas 20, 22 may be: separate locations in a single residence unit or locations available to a plurality of users. The areas have guard rails 21, 23 respectively. Each user as hereinafter explained in detail may unload cargo 24 from the rear of the vehicle 18 unto the lift 10 for elevation adjacent the railing of the desired area and convenient and safe unloading thereat, as well as lowering goods from the areas for vehicle transport.

The lift 10 comprises a vertical mast 30 attached to a ground support base 32 at ground level and by bracing 34 adjacent the top of the building 14. A cargo carrier 36 powered by an electric drive unit 38 operated by control unit 39 controls transfer of goods between the vertically separated areas.

Figure 5:
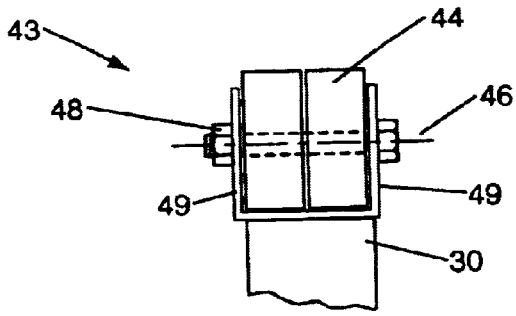
FIG. 5 is a fragmentary front view of the upper roller assembly for the mast.
Figure 3:
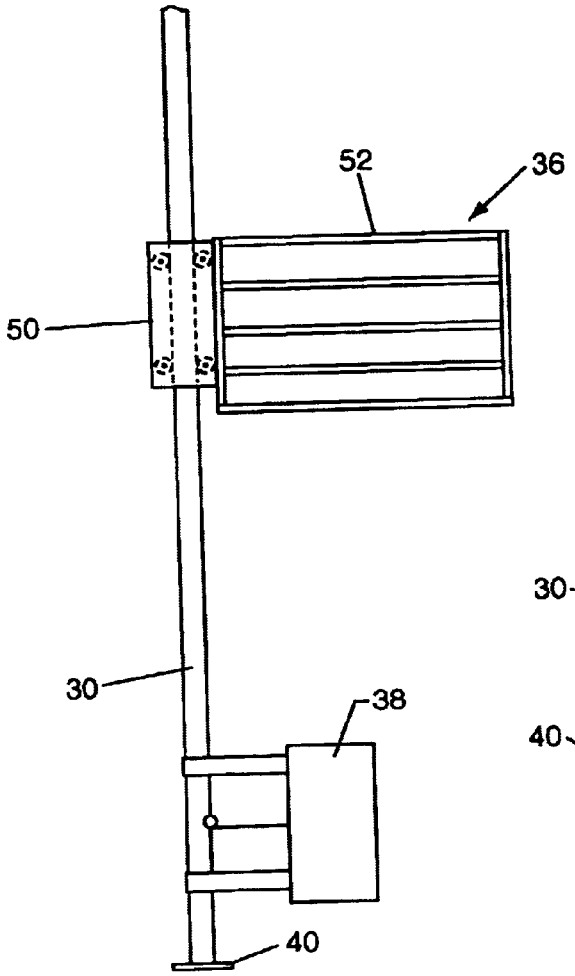
FIG. 3 is a side cross sectional view of the cargo lift.
Figure 4:
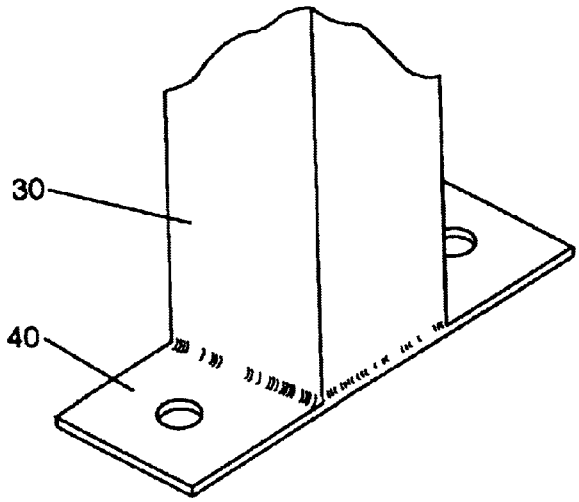
FIG. 4 is a fragmentary perspective view of the base for the cargo lift.

Referring additionally to FIGS. 3 through 5, the mast 30 is preferably an elongated rectangular cross section from stainless, galvanized or otherwise corrosion protected material. The mast 30 has a rectangular base plate 40 welded to the lower end and connected to the support base 32 by fasteners 42. The base may be any suitable supporting structure such as an existing driveway apron or a separately installed support pad. The upper end of the mast 30 includes an upper roller assembly 43 including a grooved roller 44 pivotally supported for rotation about a horizontal axis 46 by bolt 48 carried by side plates 49.

Figure 6:
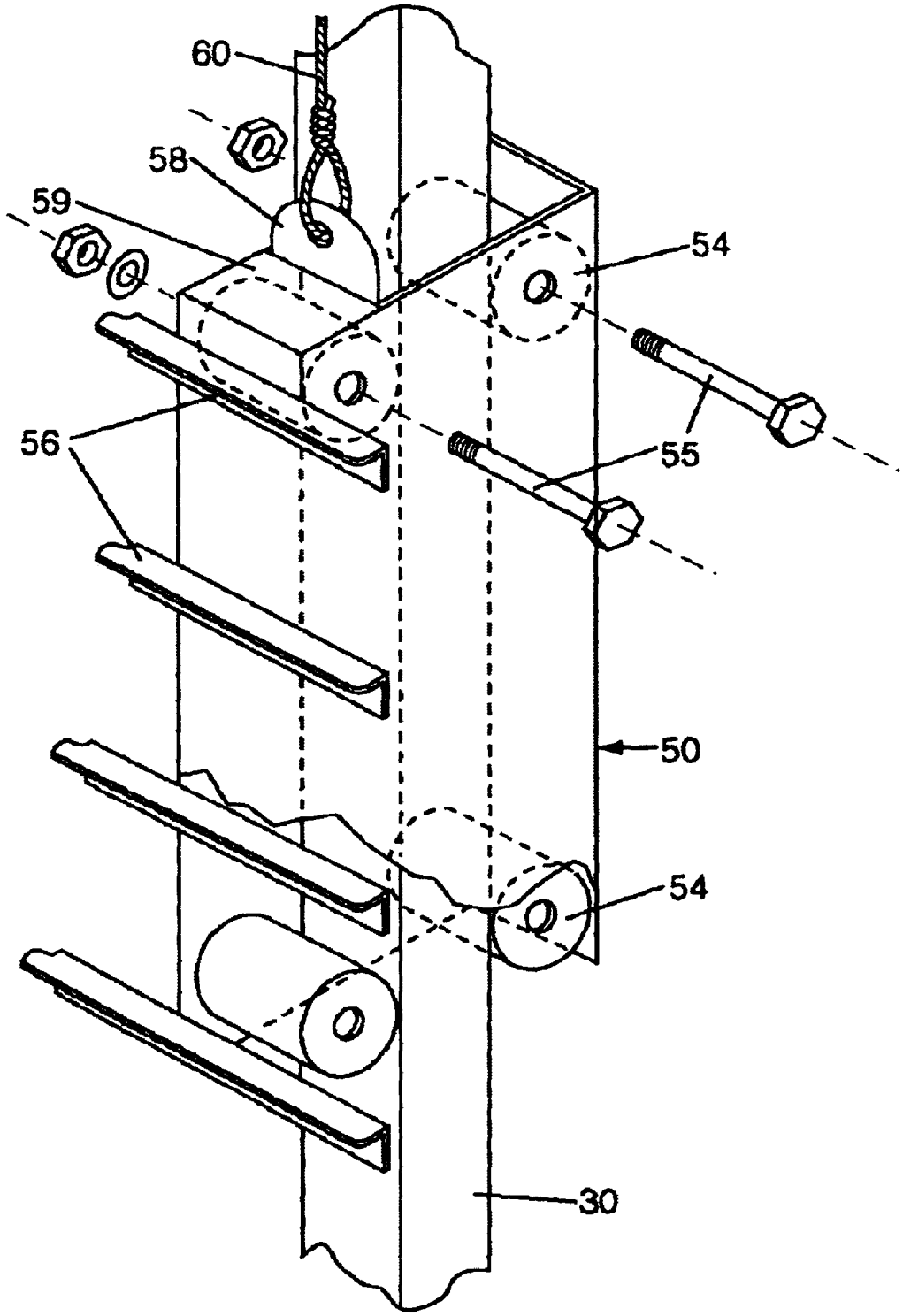
FIG. 6 is a partially broken perspective view of the carrier sleeve for the cargo lift illustrating details of construction.
Figure 7:
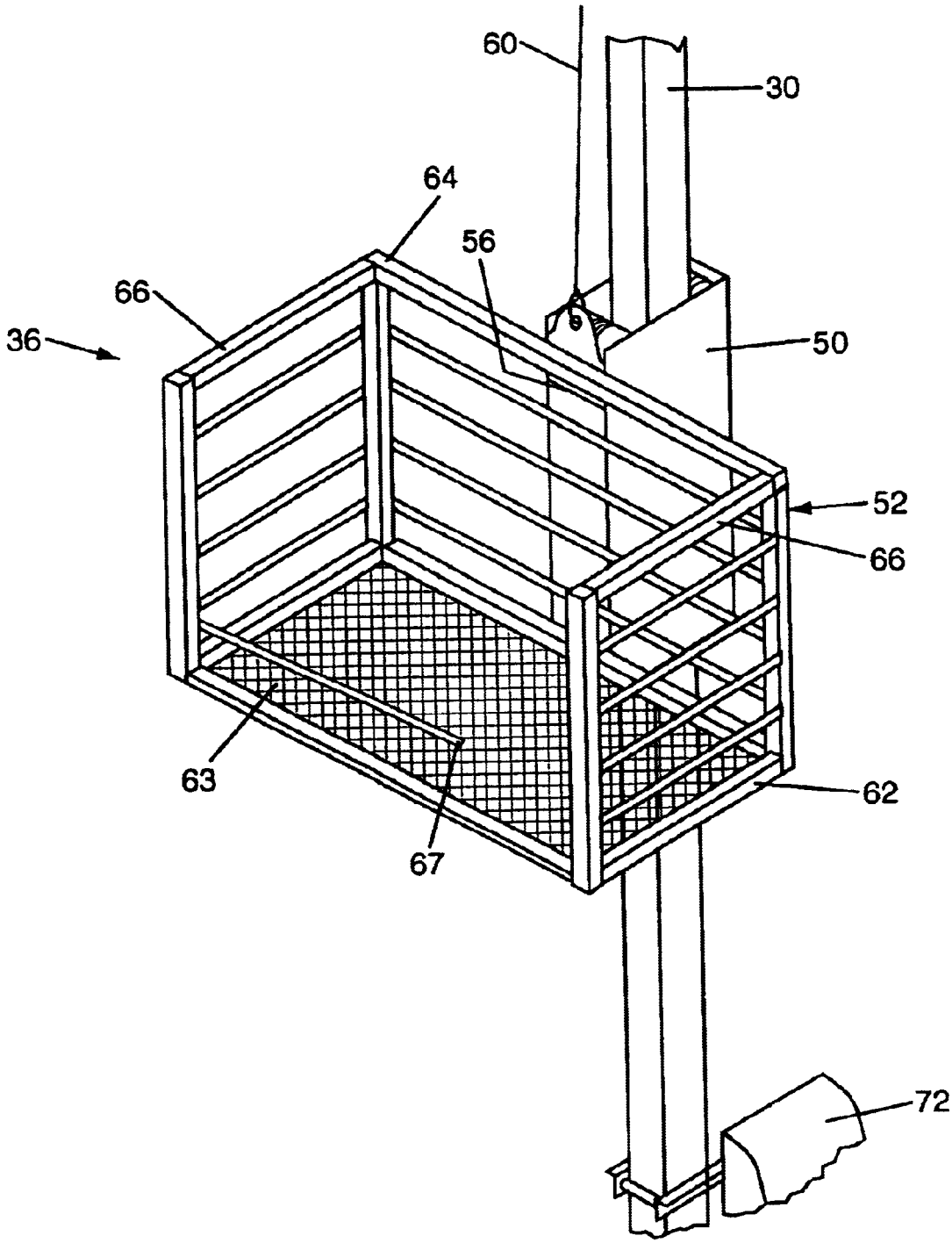
FIG. 7 is an enlarged partial perspective view of the container for the cargo lift.

The cargo carrier 36 comprises a carrier sleeve 50 and cargo basket 52. The sleeve 50 is telescopically received over the mast 30 and also formed of a galvanized or otherwise corrosion protected rectangular steel tube. As shown in FIG. 6, four rollers 54 are rotatably supported on fasteners 55 interior of the sleeve 50 in rolling engagement with opposed side surfaces of the mast 30. A plurality of bracket angles 56 are horizontally attached by welds to the outer lateral vertical wall of the sleeve 50. A lifting tab 58 is attached to cover plate 59 and the outer upper end of the sleeve 52. A lifting cable 60 is looped through and opening in the. lifting tab 58 and fastened to provide a lifting loop. Accordingly, in response to a lifting or lowering of the cable 60, the sleeve 50 vertically. traverses on the rollers 54 upwardly and downwardly on the mast, with the rollers providing guided support. Referring to FIG. 7, the cargo basket 52 is attached at the bracket angles 56 to and cantilevered from the sleeve 50. The basket defines a frontally and upwardly opening container for carrying the cargo 24. The basket 52 includes a rectangular base frame 62 having an expanded metal deck 63, a rear wall frame 64 and side wall frames 66. The basket 60 is formed of welded angle and has an expanded metal deck 63 attached to the base 62.

Figure 10:
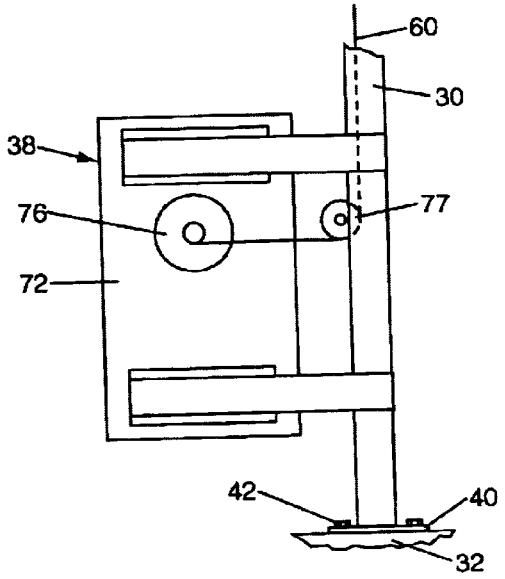
FIG. 10 is an enlarged fragmentary view of drive unit for the cargo lift.
Figure 11:
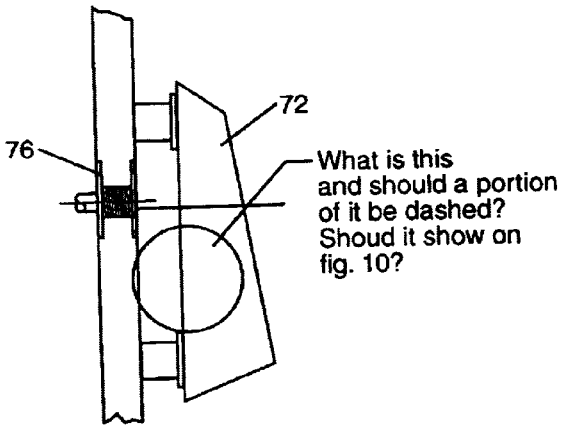
FIG. 11 is a front view of the winch for the cargo lift.

Referring to FIGS. 10 and 11, the drive unit 38 is attached by support arms 70 at the lower end of the mast 30. The upper support arm 70 functions as an abutment surface to establish the lower, cargo loading position of the lift. The drive unit 38 comprises a commercially available electrically power winch 72, such as a boat hoist, having the cable 60 carried on a cable drum 76. The cable 60 is threaded over a roller 77 supported at a side opening in the sleeve 50 on the mast 30 adjacent to the drum 76. The cable 60 passes upwardly through the interior of the mast 30 through a side opening at the roller assembly, over the roller 46 and within the groove therein, and downwardly along the mast 30 for attachment to the lifting tab 58 on the sleeve 50.

Figure 8:
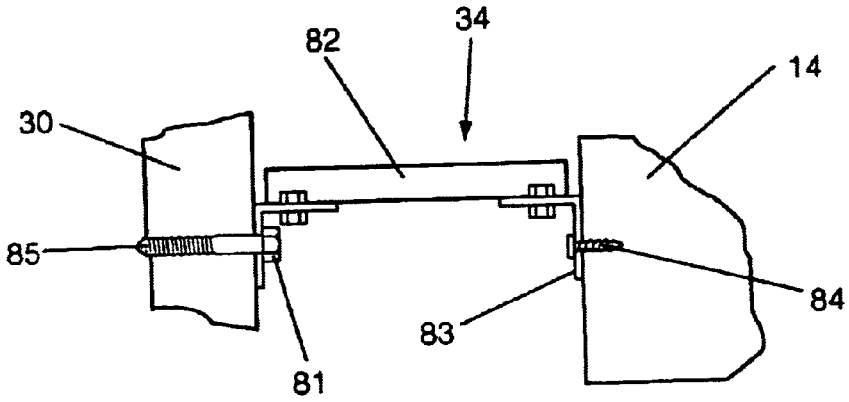
FIG. 8 is a side view of the top bracing for the mast of the cargo lift illustrating attachment to the building.
Figure 9:
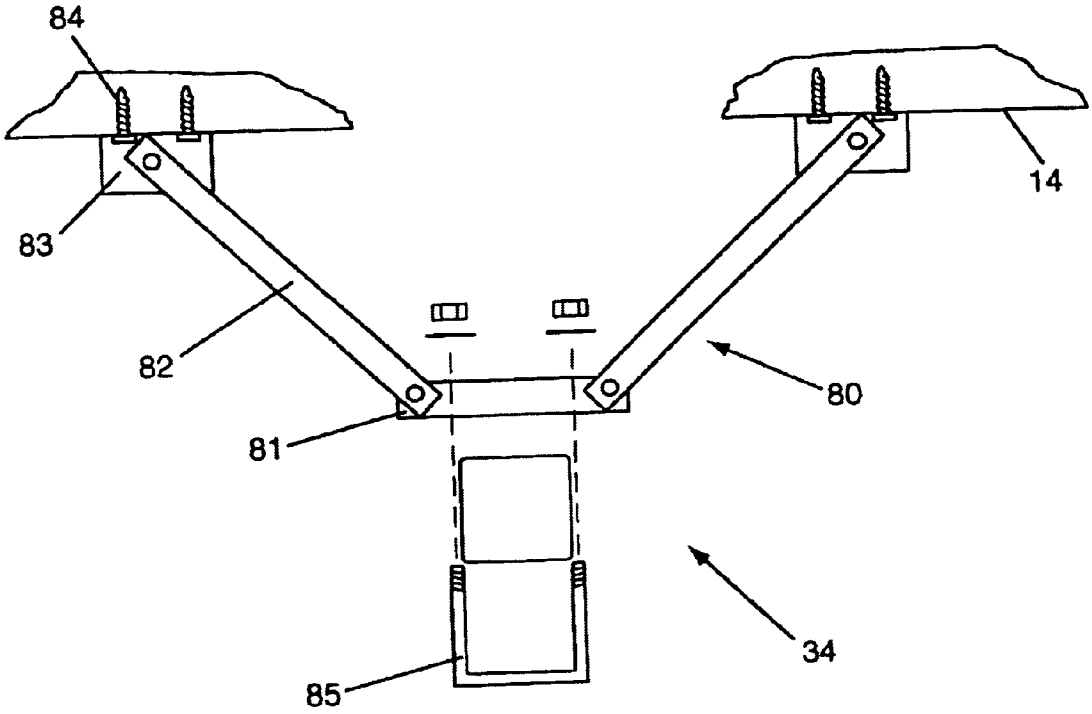
FIG. 9 is a top view of the top bracing.

As shown in FIGS. 1 and 8 and 9, the bracing 34 for connecting the upper end of the mast 30 to the building 14 includes an inner brace 80 having a base 81 engaging the inner rear wall of the mast 30, a pair of outwardly diverging arms 82 having pivotal angle brackets 83 attached to the building 14 by fasteners 84. A U-bolt 85 encircles the front and sides of the mast 30 and is adjustably clamped to the base 81 by fasteners 86. The bracing 34 may be limitedly adjusted upwardly or downwardly to an appropriate attachment surface on the building without interfering with the operation of the lift.

Figure 12:
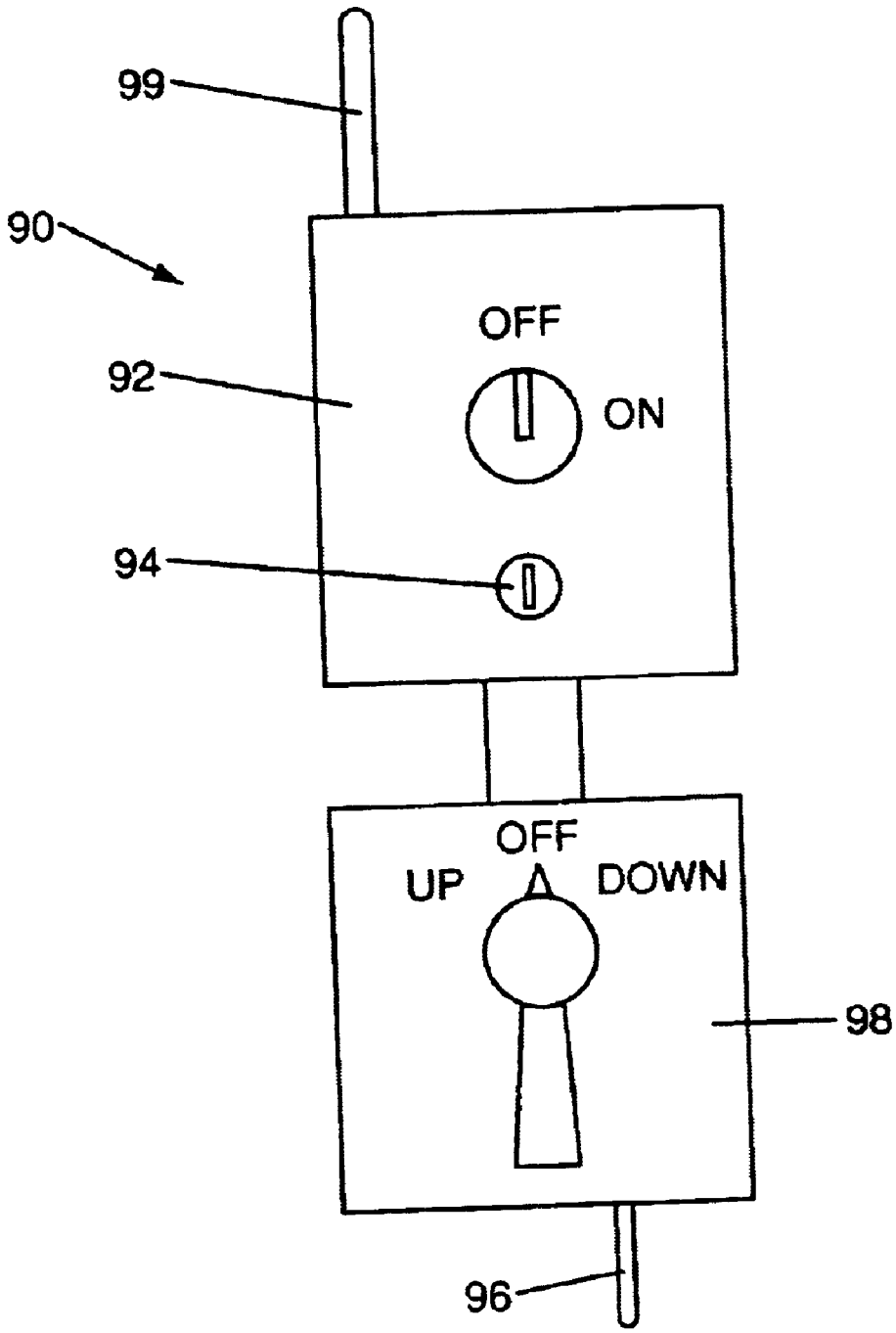
FIG. 12 is a front view of the control unit for the cargo lift

Referring to FIG. 12, the drive unit 38 is selectively operated by control unit 90, which is operable by the user to route the container 52 between ground level 16 and the vertical areas 20, 22 as shown in FIG. 1. The control unit 90 is mounted adjacent the ground level loading zone on the side of the building 14 or other convenient location. The control unit 90 comprises a switch module 92 enabled by lock mechanism 94 and connected by cable 95 to the residential power supply 96 through selector switch 98 and to the drive unit 38 by cable 99. The switch module 92 is toggled between "on" and "off" positions after enablement by an appropriate key at the lock mechanism. The selector switch 98 is operable between "off" and "up" and "down" positions after enablement to selectively vertically raise and lower the cargo container between the desired elevations. Through appropriate switches, such as limit switch 100, and circuitry, the container may be automatically transported to discrete vertical locations.

Figure 13:
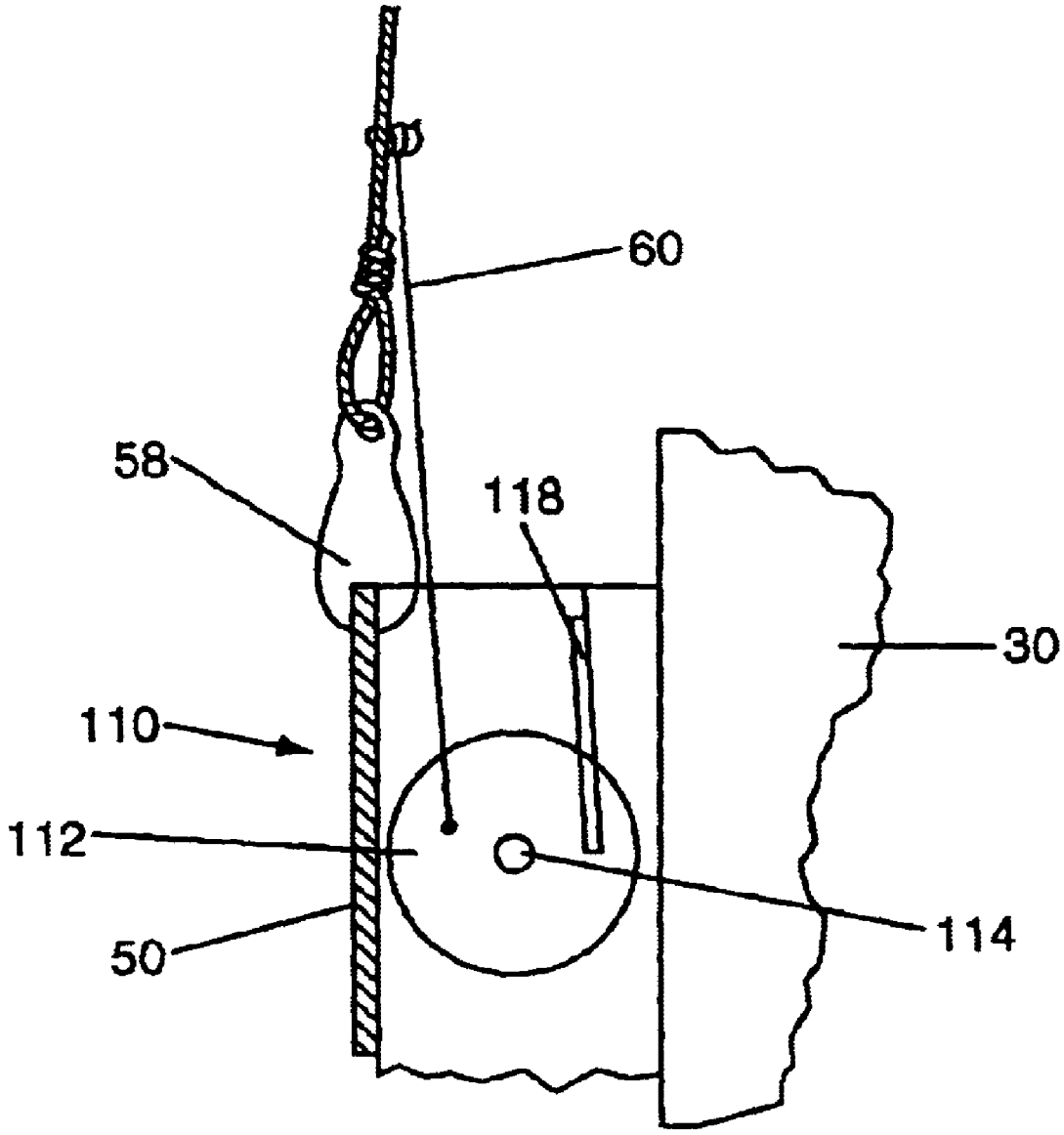
FIG. 13 is an enlarged fragmentary view of the braking mechanism for the cargo lift.

The cargo lift 10 as shown in FIG. 13 may be provided with an emergency braking mechanism 110 for preventing downward movement of the sleeve 50 and container 52 in the event for any reason tension on the cable 60 is lost. The mechanism 110 comprises an eccentrically mounted cam roller 112 rotatably mounted on the sleeve at fastener 114. The cam roller 112 is located at the upper front of the sleeve 50 at a guiding, but minimally load bearing, location. A tensioning cable 116 is attached at a lower end to the roller 112 at an outboard location and at the upper end to the lifting cable 60 at a location above the support tab 58. A tension spring 118 is attached at a lower end opposite the tensioning cable 116 and at an upper end to the top of the sleeve. The tensioning cable 116 maintains the roller 112 spaced from the mast 30 as long as the lifting cable 60 is loaded. If loading in removed from the lifting cable 60, the spring 118 pivots the roller 112 counterclockwise into cammed engagement with the mast 30 to brake the sleeve against downward movement.

Figure 14:
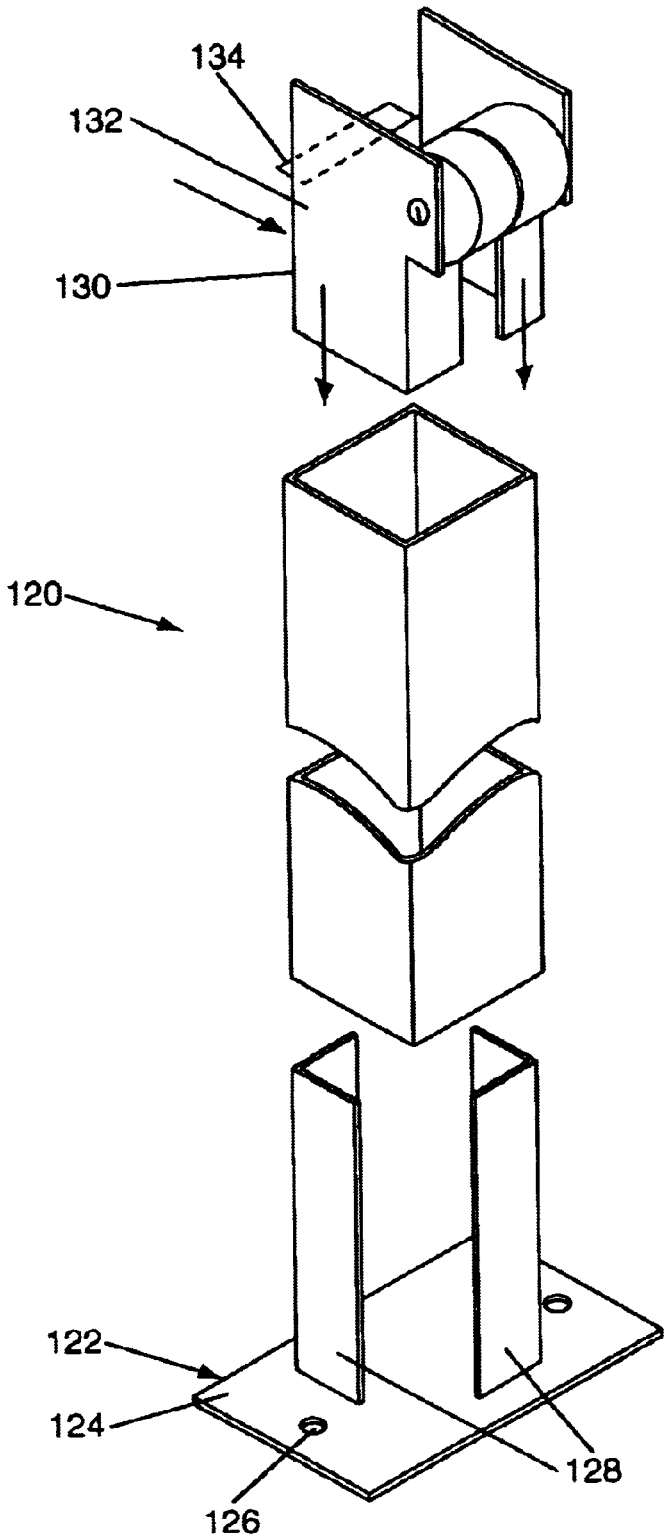
FIG. 14 is a fragmentary perspective view of another embodiment of the mast assembly for the cargo lift.

In many instances, the proper dimensions for the lift can be determined only after on site measurements. The mast assembly 120 as illustrated in FIG. 14 allows for on site determination of mast length and ready assembly of the base unit and upper roller assembly. Therein, a base assembly 122 includes a rectangular base plate 124 with suitable apertures 126 for mounting at the base 32 and a pair of upwardly extending locating angles 128 adapted to be telescopically received within the lower end of the mast 30. Similarly the upper roller assembly 130 includes location bracket 132 that is downwardly telescopically received within the upper end of the mast. The bracket 132 includes projecting tab 134 for engaging the sleeve to establish the vertical positioning of the upper roller assembly 130. The assembled components may be connected with auxiliary fasteners, not shown.

In use, the user locates the vehicle with the trunk or cargo area adjacent the container in the lowered position at the drive unit 38. The container 52 is loaded with the goods and supplies, and the drive unit 38 enabled by actuation of the key mechanism 94. The switch unit 92 is actuated to the "on" position, and the drive motor energized at switch 98 to operate the winch 72 and raise the container 52 to the areas 20, 22 for access to the contents at the railings thereof. After unloading, the container is lowered to the stowed position, the key mechanism 94 deactivated for secure storage until used by the next authorized user.

It will be apparent that other control features may be incorporated within the aforedescribed embodiment for allowing residents in multistory residential environments to avoid the need for stairway transporting cargo and other household goods.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. In combination with a residential building and a vehicle, said building having a vehicle loading area at ground level adjacent the building and an exterior landing area with a railing at an elevation above the ground level, said vehicle having a raised cargo area above said ground level, a residential cargo lift for transferring goods between said cargo bed of said vehicle and said landing area, comprising: a vertically extending elongated one piece tubular mast member of rectangular cross section, said mast member having a lower end supported adjacent the landing area and the building and an upper end with an open upper end support at the building above said railing; a horizontally extending support member connected to said mast member above said ground level and vertically aligned with the cargo area of vehicle; a one-piece tubular sleeve member of rectangular cross section telescopically received over said mast member; roller means between said sleeve member and said mast member for establishing rolling contact therebetween and accommodating relative vertical movement between a lower position whereat said sleeve member engages said support member and an upper position adjacent the railing at the landing area; a container connected to said sleeve member; said container being accessible in said lower position for transferring cargo from the cargo bed of the vehicle and accessible at said railing in said raised position for unloading the cargo; a lower opening formed in said mast member adjacent said support member; a lower roller supported on said mast member adjacent said lower opening; an upper roller supported on said mast member adjacent said upper opening; an electrically operated winch connected to said support member; a cable operatively associated with said winch and serially routed therefrom horizontally over said lower roller, upwardly through said mast member, horizontally over said upper roller and downwardly exterior of said mast member with a free end attached to said sleeve member; control means for operating said winch located at ground level adjacent said loading area, said control means including locking means for enabling said control means and selector means operative after said enabling for operating said winch to move said sleeve member and container between said lower position and said upper position.

2. The cargo lift as recited in claim 1 wherein said winch is electrically powered.

3. The cargo lift as recited in claim 2 wherein said roller means includes cylindrical rollers carried by said sleeve member and engaging said mast member.

4. The cargo lift as recited in claim 3 wherein said container means includes a horizontal base wall, laterally spaced side walls, and a rear wall defining said loading area.

5. The cargo lift as recited in claim 4 wherein said base wall includes a frame member covered with an expanded mesh.

6. The cargo lift as recited in claim 4 wherein a base member is telescopically received within the lower end of the mast member for attachment to a base at ground level.

7. The cargo lift as recited in claim 4 wherein one of said roller means is spring biased into cammed engagement with said mast member in the event of loss of tension at said cable.

8. The cargo lift as recited in claim 4 wherein said control means includes a locking mechanism for restricting operation of said drive unit to authorized users.

9. The cargo lift as recited in claim 8 including switch means for disabling said drive unit at said raised position.

* * * * *